United States Patent [19]

Decker

[11] 4,112,643

[45] Sep. 12, 1978

[54] SNUB ASSEMBLY FOR SECURING COVERING MATERIAL TO A WALL PANEL MODULE

[75] Inventor: Lloyd Burr Decker, Colon, Mich.

[73] Assignee: Harter Corporation, Sturgis, Mich.

[21] Appl. No.: 795,415

[22] Filed: May 9, 1977

[51] Int. Cl.[2] ..... E04B 1/82

[52] U.S. Cl. ..... 52/222; 160/135; 160/395; 52/829

[58] Field of Search ..... 52/222, 620, 624; 160/135, 327, 383, 387, 392, 395, 396, 399, 403

[56] References Cited

U.S. PATENT DOCUMENTS

| | | | |
|---|---|---|---|
| 3,448,551 | 6/1969 | Heller | 52/222 |
| 3,757,479 | 9/1973 | Martinez | 52/222 |
| 3,768,222 | 10/1973 | Birum, Jr. | 160/135 X |
| 3,783,931 | 1/1974 | Assael | 52/222 X |
| 3,811,454 | 5/1974 | Huddle | 160/395 X |
| 4,026,081 | 5/1977 | Delaney | 52/222 |

*Primary Examiner*—Alfred C. Perham

*Attorney, Agent, or Firm*—Hamilton, Renner & Kenner

[57] ABSTRACT

A snubbing assembly for releasably securing a sheet of covering material to a wall panel module. The peripheral frame of the wall panel module is comprised of channels having a web wall and at least one side wall. The channels are disposed with the web wall facing inwardly of the module and with the side wall extending outwardly thereof. A longitudinal flange extends parallel with the side wall and is spaced laterally inwardly thereof to present a footed snub. Selectively movable gate means are carried by the channel to oppose the snub. An anchor means is secured to the marginal edge portion of the covering material and is releasably secured by the opposed interaction of the snub and gate means to maintain the covering material tautly upon the face of the wall panel module.

5 Claims, 4 Drawing Figures

SNUB ASSEMBLY FOR SECURING COVERING MATERIAL TO A WALL PANEL MODULE

BACKGROUND OF THE INVENTION

A snubbing assembly of the type to which the present invention is directed is intended for use in conjunction with a free-standing, knockdown, readily assembled and disassembled, relocatable wall and space divider of the type used to compartmentalize open floor areas, as desired, for internal functional use, and particularly for use in conjunction with a modular wall panel structure adopted for use with such a wall. A preferred form for such a divider wall is disclosed in U.S. Appln. Ser. No. 728,383, filed Sept. 30, 1976 and owned by my Assignee, and a preferred form for such a wall panel module is disclosed in copending U.S. Appln. Ser. No. 728,433, also filed Sept. 30, 1976 and owned by my Assignee.

Such a divider wall incorporates a frame which presents one or more quadrilateral openings, or panel receiving loci, into which one or more modular wall panels are releasably received.

The modular wall panel has a rectangular frame with outwardly opening side channels for receiving a spline retainer. In the preferred arrangement a vertically oriented spline is employed at the juncture between successive wall panels positioned within the panel receiving loci. The spline may be secured to the frame such that the spline is translatable laterally of itself within the plane of that portion of the frame to which it is secured selectively to engage or disengage the outwardly opening side channels in successively abutting wall panels, thereby releasably securing the wall panels to the frame. Similar splines are also provided to effect a releasable connection between the wall panels and the vertical frame member delineating the lateral edges of the panel receiving loci.

Decorative sheet materials may be conveniently applied to, and removed from, the exposed faces of the wall panel modules to facilitate decorating, and redecorating, of the divider wall. In the embodiment disclosed in the aforesaid U.S. Appln. Ser. No. 728,433, a plurality of flat snubbing pieces, or plates, are provided to hold the marginal edge portions of the covering sheets tightly within the outwardly opening side channels. These snubbing pieces are thin, flexible and preferably made of a suitable synthetic plastic material. As such, they are designed cooperatively to interact with the configuration of the wall panel frame to hold the tensioned fabric in place.

Although one can become quite adept at applying and removing the decorative covering material by use of such snubbing plates, it does require considerable manual dexterity, which can only be acquired through experience, to apply the fabric so that it does not pucker along the perimeter of the wall panel module.

SUMMARY OF THE INVENTION

It is, therefore, a primary object of the present invention to provide an improved snubbing assembly by which releasably to secure a sheet of covering material to a wall panel module.

It is another object of the present invention to provide an improved snubbing assembly, as above, which requires no special skills, tools or particular manual dexterity to secure or release.

It is a further object of the present invention to provide an improved snubbing assembly, as above, which facilitates applying the covering material without unsightly puckering along the edge of the wall panel module.

These and other objects of the present invention, as well as the advantages thereof over existing and prior art forms, will be apparent in view of the following detailed description of the attached drawings and are accomplished by means hereinafter described and claimed.

In general, a snubbing assembly embodying the concept of the present invention is adapted releasably to secure a covering sheet of material onto the face of a wall panel module. The sheet material is provided with a hemmed pocket along the marginal edge portions thereof, and an anchor means, preferably in the form of a rod, is insertably received within the pocket.

The peripheral frame of the wall panel module presents a footed snub. In the preferred form of the invention the footed snub is located interiorly of the outwardly directed channel members forming the peripheral frame.

A gate means, which is preferably movable on a flexible arm, is carried on the peripheral frame of the wall panel so as to oppose the snub. The gate means may be manually moved to insert the anchor means behind the snub and then be returned to its normal disposition in opposition to the snub whereby lockingly to retain the anchor means and thereby secure the covering material onto the face of the wall panel module. Removal of the covering material may be accomplished by manually moving the gate means to release the anchor means.

One preferred embodiment of a snubbing assembly embodying the concept of the present invention is shown by way of example in the accompanying drawings and is described in detail without attempting to show all of the various forms and modifications in which the invention might be embodied; the scope of the invention being measured by the appended claims and not by the details of the specification.

DESCRIPTION OF THE PREFERRED EMBODIMENT

The novel and unique snubbing assembly indicated generally by the numeral 10 in the attached drawings is particularly adapted to be incorporated in the type panel module disclosed in U.S. Appln. Ser. No. 728,433 filed Sept. 30, 1976 and also owned by the assignee of the subject invention.

A panel module of the general type disclosed in said U.S. Appln. Ser. No. 728,433, but modified to provide a snubbing assembly according to the concept of the present invention, is depicted herein and identified generally by the numeral 11. Such panel modules 11 are mounted in panel receiving loci delineated by the frame of a divider wall of the type disclosed in U.S. Appln. Ser. No. 728,383, filed Sept. 30, 1976 and also owned by the assignee of the subject invention. The wall frame includes not only horizontally spaced, vertical support members but also horizontally oriented upper, or top, members and horizontally oriented lower members spaced vertically downwardly from the top member.

One or more panel modules 11 may be received, and releasably secured, within the quadrilateral openings, or panel receiving loci, defined by the wall frame.

Figure 1:
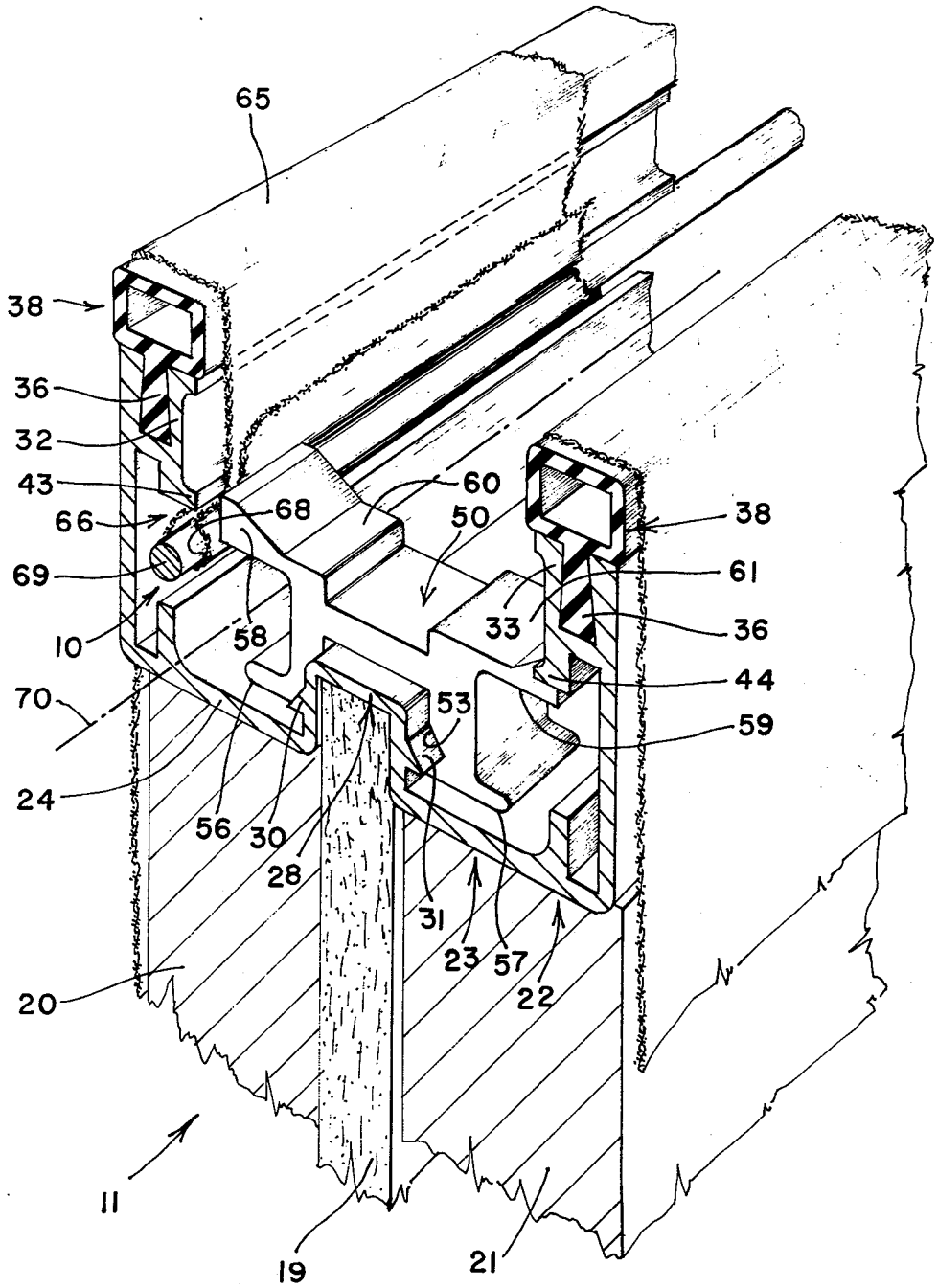
FIG. 1 is a perspective view of a section through the peripheral frame of a modular wall panel in which a snubbing assembly embodying the concept of the present invention is employed to secure a sheet of covering material onto the face of the panel module.

As best seen in FIG. 1, each panel member 11 is preferably provided with a stiff central core ply 19 of fiberboard, or the like, with laminations 20 and 21 of accoustical material presented from opposite sides thereof. The core ply 19 and laminations 20 and 21 are secured within a subframe — i.e., the panel frame 22—which comprises preferably identical top, bottom and side channels 23.

Figure 2:
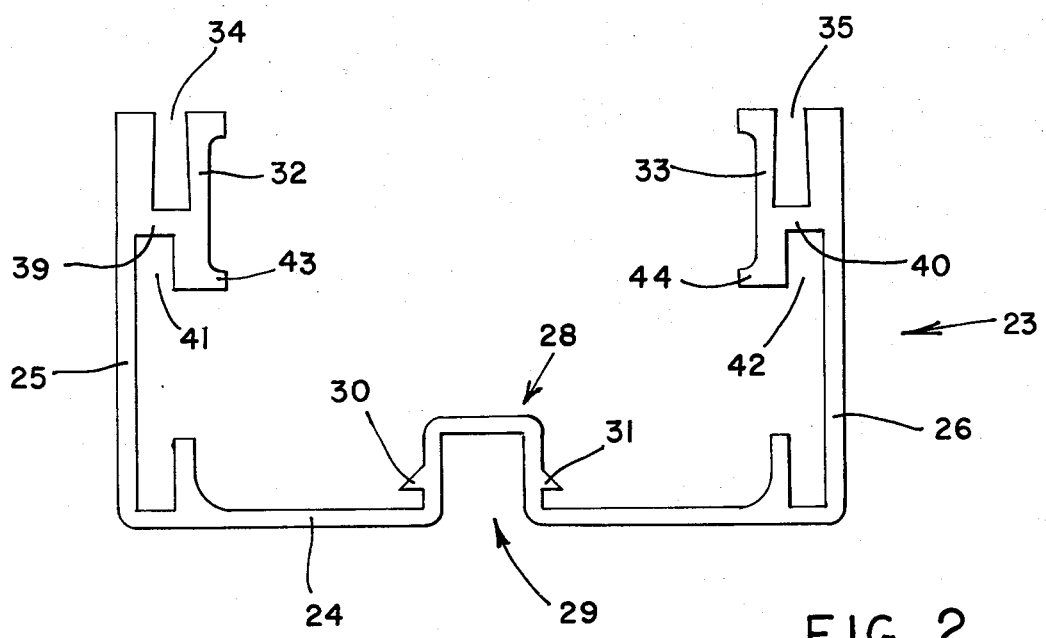
FIG. 2 is an end elevation of a channel member from which the peripheral frame of the modular wall panel depicted in FIG. 1 is made.

The channels 23, as best seen in FIG. 2, have a web wall 24 which abuts the laminations 20 and 21. The side walls 25 and 26 extend in parallel relation outwardly from the lateral edges of the web wall 24 such that the channels 23 open outwardly away from the core ply 19. Each web wall 24 has an internal, medial rib 28 extending longitudinally of the channel 23 and forming an external groove 29 to receive a projecting edge of the core ply 19. The medial rib 28 is also provided with oppositely directed spurs 30 and 31 which preferably extend parallel to the web wall 24 for a purpose more fully hereinafter described.

Spaced laterally inwardly of the side walls 25 and 26 and extending parallel therewith along the edges of the side walls outwardly of the web are longitudinal flanges 32 and 33, respectively. Longitudinal flange 32, in conjunction with the outer edge of side wall 25 forms an outwardly facing groove 34 and longitudinal flange 33, in conjunction with the outer edge of side wall 26 forms an outwardly facing groove 35. The grooves 34 and 35 are each adapted to receive the stem 36 of a T-shaped, resilient strip 38 (FIG. 1).

The bases of grooves 34 and 35 are defined by respective bridge walls 39 and 40, and the longitudinal flanges 32 and 33 project beyond the bridge walls 39 and 40 to form, in conjunction with the side walls 25 and 26, second grooves 41 and 42 which face oppositely of grooves 34 and 35—i.e., grooves 41 and 42 face the web wall 24. The innermost extremity of each longitudinal flange 32 and 33 terminates in a footed snub 43 and 44, respectively, the purpose of which will hereinafter become more fully apparent.

Figure 3:
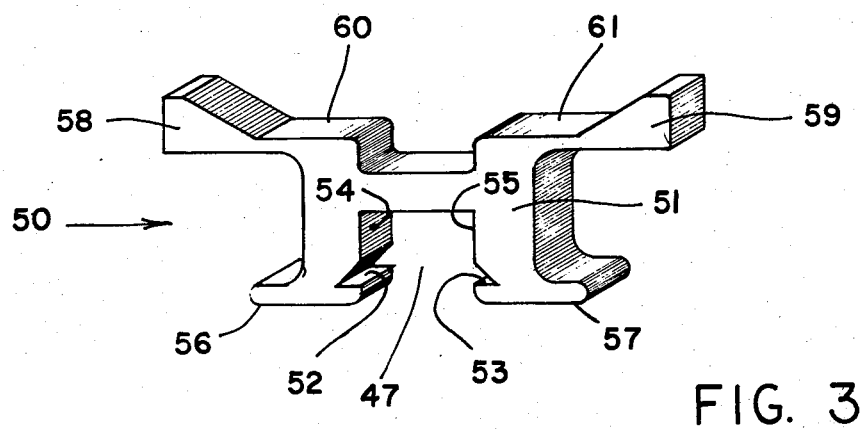
FIG. 3 is a perspective view of a retainer clip employed in conjunction with the channel member depicted in FIG. 2 to provide a snubbing assembly embodying the concept of the present invention; and, FIG. 4 is an end elevation of a pocket hemmed into the marginal edge portion of a sheet of covering material to receive an anchor rod which will interact with the panel frame channel and retainer clip depicted in FIGS. 2 and 3, respectively, in order releasably to secure the covering material onto the face of a modular wall panel.
Figure 4:
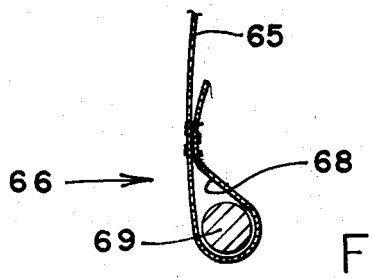

A plurality of retainer clips 50, as best seen in FIG. 3, are positioned within the channels 23. The body portion 51 of each retainer clip 50 has a recess 47 matingly to engage the medial rib 28. Opposed, lateral notches 52 and 53 are provided in the lateral surfaces 54 and 55 of the recess 47 to engage the spurs 30 and 31 by which the retainer clip 50 remains selectively conjoined with the medial rib 28. The body portion 51 is also preferably provided with feet 56 and 57 to engage the web wall 24 of the channel 23 in opposition to the retentive engagement of the spurs 30 and 31 with the respective notches 52 and 53 to stabilize the attachment of the retainer clip 50 to the channel 23.

A pair of retaining gates 58 and 59 are supported from the body portion 51 of the retainer clip 50 by corresponding arms 60 and 61. The arms 60 and 61 must be sufficiently flexible to permit each gate to swing as hereinafter more fully described.

Referring again to FIG. 1 it will be observed that when the retainer clip 50 is mounted on the medial rib 28 in channel 23 the gates 58 and 59 are located in general opposition, though slightly below (i.e., closer to the web 24 of channel 23) and in close proximity, to the respective snubs 43 and 44. The opposedly juxtaposed disposition of the gates and their respective snubs serves selectively to permit the application and removal of decorative sheet material to the wall panel module.

The decorative sheet covering material 65 may be selected from a variety of materials such as molded, extruded or woven synthetic or natural sheeting. Each marginal edge portion 66 of the covering sheet material 65 for each wall panel module is, as best seen in FIG. 6, hemmed to form a pocket 68, and an anchor rod 69 is received therein.

When the hemmed pockets 68 are properly disposed, each marginal edge portion 66 of the covering sheet material 65 is pulled tautly over the corresponding, hollow, resilient strip 38 on the channels 23 defining the sides of the panel frame 22, and the marginal edge portions are folded over the resilient strips 38 in order that the anchor rod 69 in pockets 68 may be snapped between the appropriate gates and snubs for retention inwardly of the snub.

At such time as the covering sheet material 65 is to be replaced, one simply depresses the appropriate gate to release the anchor rod. Thus, it is necessary that the arms 60 and 61 be sufficiently flexible to permit the gates 58 and 59 to swing about an axis parallel to the longitudinal extent of the footed snub with which that arm is associated. As an example, axis 70 depicted in FIG. 1 lies parallel with the longitudinal extent of snub 43, and the arm 60 is associated therewith because it presents the gate 50 in opposed juxtaposition with respect thereto.

The necessary flexibility can be achieved by a judicious selection of the material from which the retaining clip 50 is made in conjunction with the dimensions of the arms 60 and 61. It has proven quite convenient to make the retainer clip 50 of unitary, or one-piece, construction from a material such as filled, or unfilled, thermoset or thermoplastic, with high density polyethylene being typical. Such plastics may be fabricated by any of the well-known processes such as injection, compression, transfer or blow molding; extrusion; pultrusion; mechanical forming; or, casting.

Continuing with the example of a polyethylene retainer clip, the arm dimensions may be readily chosen to provide sufficient strength to retain the anchor rod beneath the snub against the pressure applied by a tautly stretched cover material and yet have sufficient flexibility to permit selective insertion and removal with facility.

Similarly, the anchor rod 69 must be carefully chosen to have sufficient size to be retained by the opposing action of the gates and snub and also to have sufficient strength to retain the fabric between widely spaced retainer clips 50. One-eighth inch diameter steel rods work quite well and permit spacing of the retainer clips at 2-foot intervals without releasing too much tension on the span of the covering material therebetween.

It should now be apparent that a snubbing assembly embodying the concept of the present invention provides an improved means by which releasably to secure a sheet of covering material to a wall panel module and otherwise accomplishes the objects of the invention.

I claim:

1. A snubbing assembly for releasably securing a sheet of covering material onto the face of a wall panel module having a peripheral frame, said peripheral frame being comprised of channels having a web wall and at least one side wall, the channels being disposed with the web wall facing inwardly with respect to the wall panel module and the side wall extending outwardly with respect to the wall panel module, a longitudinal flange extending parallel with the side wall and spaced laterally inwardly thereof, a snub being presented from said longitudinal flange, a medial rib being provided along the web wall of the channels forming the wall panel frame, at least one retainer clip, said retainer clip recessed matingly to receive said medial rib, means by which selectively to secure the body portion of said retainer clip to said medial rib, gate means being presented from said retainer clip, a sheet of material having a marginal edge portion being disposed on the face of the wall panel module, an anchor means secured to the marginal edge portion of said covering material, the marginal edge portion of the decorative sheet extending between said opposed snub and gate means, the anchor means being releasably secured behind said snub and gate means tautly to maintain the decorative sheet material on the face of the wall panel module.

2. A snubbing assembly, as set forth in claim 1, in which spurs extend laterally outwardly of said medial rib, notches being provided in the recess to receive said spurs and thereby selectively secure said retainer clip to said medial rib.

3. A snubbing assembly, as set forth in claim 2, in which a flexible arm connects said gate means to the body portion of said retainer clip.

4. A snubbing assembly, as set forth in claim 3, in which the anchor means comprises a rod secured to the marginal edge portion of the covering material.

5. A snubbing assembly, as set forth in claim 4, in which a pocket is hemmed into the marginal edge portion of the covering material, said rod being received therein.

* * * * *